US008385799B2

(12) United States Patent
Miyamoto

(10) Patent No.: US 8,385,799 B2
(45) Date of Patent: Feb. 26, 2013

(54) LUBRICATING DEVICE, FIXING DEVICE, AND IMAGE FORMING APPARATUS

(75) Inventor: Atsushi Miyamoto, Ibaraki (JP)

(73) Assignee: Ricoh Company, Limited, Tokyo (JP)

( * ) Notice: Subject to any disclaimer, the term of this patent is extended or adjusted under 35 U.S.C. 154(b) by 309 days.

(21) Appl. No.: 12/830,624

(22) Filed: Jul. 6, 2010

(65) Prior Publication Data

US 2011/0013953 A1 Jan. 20, 2011

(30) Foreign Application Priority Data

Jul. 15, 2009 (JP) ..... 2009-166660

(51) Int. Cl.
*G03G 15/20* (2006.01)

(52) U.S. Cl. ..... 399/325

(58) Field of Classification Search ..... 399/320, 399/325

See application file for complete search history.

(56) References Cited

U.S. PATENT DOCUMENTS

| | | | | |
|---|---|---|---|---|
| 6,072,978 | A * | 6/2000 | Wittmann | 399/325 |
| 2005/0175379 | A1* | 8/2005 | Berg et al. | 399/325 |

FOREIGN PATENT DOCUMENTS

| | | |
|---|---|---|
| JP | 58-182673 | 10/1983 |
| JP | 61-46965 | 3/1986 |
| JP | 62-44783 | 2/1987 |
| JP | 6-79189 | 10/1994 |
| JP | 9-54512 | 2/1997 |
| JP | 10-307503 | 11/1998 |
| JP | 11-258945 | 9/1999 |
| JP | 11-272106 | 10/1999 |
| JP | 2003-5562 | 1/2003 |
| JP | 2004-37556 | 2/2004 |
| JP | 2008-102412 | 5/2008 |

OTHER PUBLICATIONS

Machine translation of Yamagata (JP 2005134763 A). Publication date: May 26, 2005.*

* cited by examiner

*Primary Examiner* — Walter L Lindsay, Jr.
*Assistant Examiner* — Frederick Wenderoth
(74) *Attorney, Agent, or Firm* — Oblon, Spivak, McClelland, Maier & Neustadt, L.L.P.

(57) ABSTRACT

A lubricating device includes an lubricant impregnation member to coat a surface of a target member with lubricant, an lubricant supply member to supply lubricant to the lubricant impregnation member, a subsidiary roller to feed the lubricant impregnation member out, a main roller to reel in the lubricant impregnation member fed by the subsidiary roller, a drive motor to drive the main roller, an encoder disc provided at a rotational shaft of the subsidiary roller, an encoder sensor to detect a rotational state of the encoder disc, and a controller unit to calculate an outer diameter of the main roller and a portion of the lubricant impregnation member reeled by the main roller, based on a number of drive steps of the drive motor during a detection interval of the encoder disc.

9 Claims, 6 Drawing Sheets

LUBRICATING DEVICE, FIXING DEVICE, AND IMAGE FORMING APPARATUS

CROSS-REFERENCE TO RELATED APPLICATIONS

The present patent application is based on and claims priority pursuant to 35 U.S.C. §119 from Japanese Patent Application No. 2009-166660, filed on Jul. 15, 2009 in the Japan Patent Office, the entire contents of which are hereby incorporated herein by reference.

FIELD OF THE INVENTION

The present invention relates to a lubricating device, a fixing device incorporating the lubricating device, and an image forming apparatus incorporating the fixing device, and more particularly to a lubricating device, a fixing device, and an image forming apparatus that applies lubricant to a heating member of the fixing device.

BACKGROUND

Image forming apparatuses, such as copying machines, facsimile machines, printers, or multifunction apparatuses having two or more functions of copying, printing, scanning, and faxing, generally use an electrophotographic process for image forming and includes a fixing device.

In the fixing device, a heating member heats toner in a toner image formed on a recording sheet to fix the toner image onto the recording sheet. In order to suppress toner from being adhered to the surface of the heating member, a lubricating device is provided that applies lubricant such as oil to the surface of the heating member. For example, as illustrated in Japanese Patent Application Publication Nos. H09-54512-A, H06-79189, S58-182673, S61-46965, S62-44783, H10-307503, 2003-5562, 2004-37556, and 2008-102412, oil may be applied to the surface of the heating member via a felt, which is made in close contact with the heating member. More specifically, in the example case of JP-H09-54512-A, which is illustrated in FIG. 1, a felt 23 is reeled from a felt subsidiary roller 20 to a felt main roller 21 such that the contact surface of the felt 23 that is made in contact with the heating member is kept clean. In order to reel the felt 23, a drive motor 22 is provided, which rotates the felt main roller 21 at a constant angular velocity. However, as the felt 23 is reeled in, the outer diameter of the felt main roller 21 including the felt 23, which is the diameter of a rotational axis of the felt main roller 21, increases, resulting in the decrease in the circumferential velocity of the felt 23.

In view of the above-described problem, JP-H09-54512-A proposes to detect a rotational velocity of the felt subsidiary roller 20 and control the rotation velocity of the felt main roller 21 based on the detected rotational velocity, using a rotation velocity detector 24. The rotation velocity detector 24 includes an encoder disc 26 provided at one end of a rotational shaft 25 of the felt subsidiary roller 20, and an encoder sensor 27 to monitor a rotational state of the encoder disc 26.

However, the conveyance velocity of the felt conveyance mechanism is generally very slow, for example, 1 cm per hour. Accordingly, it requires a relatively long time to obtain the angular velocity of the felt subsidiary roller 20.

Further, the speed or time required for the felt 23 to be reeled may differ depending on paper, toner being used, setting temperature for the fixing device, and so forth. Furthermore, the purpose for reeling the felt may differ between when the image forming apparatus is performing a printing operation and when the image forming apparatus is not performing a printing operation. More specifically, in a printing operation, the felt is moved at a predetermined velocity to clean the heat roller 14, and to coat the heat roller 14 with oil. However, in a non-printing operation, if the felt is pressed against the heat roller without movement, the felt may be deformed due to the heat of the heat roller. Accordingly, the felt should be moved at a velocity that is slower than the velocity during printing. Thus, a plurality of velocities should be detected and determined to reflect both cases of printing operation and non-printing operation.

Referring to FIG. 2, it is assumed that a pulse generation cycle, i.e., the rotational cycle of the felt subsidiary roller 20 is Tp, a rotational velocity of the drive motor 22 in a printing operation is μp, and a rotational velocity of the drive motor 22 in a non-printing operation is μd. As previously described, the rotational velocity μd of the drive motor 22 at the non-printing operation is generally slower than the rotational velocity μd of the drive motor 22 at the printing operation. Even if the rotational velocities of the drive motor 22 are the same, the actual felt feeding speeds may be different depending on reeled condition of the felt 23.

Further, FIG. 2 represents a case in which a diameter of the felt main roller 21 in state B is larger than the diameter of the felt main roller 21 in state A. However, the pulse generation cycles Tp in both states may be the same, and in this case, according to the known lubricating device of FIG. 1, the same rotational velocity may be set in both cases even if the diameters of the felt main roller 21 actually differ between the two cases. As a result, the rotational velocity for reeling the felt 23 may become too fast or too slow.

SUMMARY

In view of the above, the inventors of the present invention have discovered that, when determining a rotational velocity of a roller that feeds a lubricant impregnation member such as felt, the outer diameter of the roller including the lubricant impregnation member being reeled by the roller, which is the diameter of a rotational axis of the roller, needs to considered.

This patent specification describes a lubricating device that includes a lubricant impregnation member to coat a surface of a target member with lubricant, a lubricant supply member to supply lubricant to the lubricant impregnation member, a subsidiary roller to feed the lubricant impregnation member out, a main roller to reel the lubricant impregnation member fed out by the subsidiary roller, a drive motor to drive the main roller, an encoder disc provided at a rotational shaft of the subsidiary roller, an encoder sensor to detect a rotational state of the encoder disc, and a roller outer diameter calculation unit to receive output from the encoder sensor and to calculate an outer diameter of the main roller and a portion of the lubricant impregnation member reeled by the main roller, based on a number of drive steps of the drive motor detected by the encoder sensor during a detection interval of the encoder disc. The outer diameter being calculated is a diameter of a rotational axis of the main roller. Further, the roller outer diameter calculation unit may be implemented as a controller unit.

The lubricating device further includes a drive velocity determination unit to determine a drive velocity of the drive motor based on the outer diameter of the main roller and the portion of the lubricant impregnation member calculated by the roller outer diameter calculation unit. The drive velocity determination unit may be implemented as a controller unit.

The above-described lubricating device may be incorporated into a fixing device, an image forming apparatus, or any image forming system.

Example embodiments of the present invention includes a method of controlling a velocity of a lubricant impregnation member, the method including: coating a surface of a target member with lubricant, using the lubricant impregnation member; supplying lubricant to the lubricant impregnation member; feeding out, by a subsidiary roller, the lubricant impregnation member; reeling in, by a main roller, the lubricant impregnation member fed out by the subsidiary roller; driving the main roller using a drive motor; providing an encoder disc at a rotational shaft of the subsidiary roller; detecting a rotational state of the encoder disc; and receiving output from the encoder sensor and calculating an outer diameter of the main roller and a portion of the lubricant impregnation member reeled by the main roller, based on a number of drive steps of the drive motor detected by the encoder sensor during a detection interval of the encoder disc. The method further includes: determining a drive velocity of the drive motor based on the calculated outer diameter of the main roller and the portion of the lubricant impregnation member.

Example embodiments of the present invention may be practiced in various other ways, for example, as a plurality of instructions that cause a computer to perform the above-described method of controlling a velocity of a lubricant impregnation member, or a recording medium storing such plurality of instructions.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF EXAMPLE EMBODIMENTS

Figure 1:
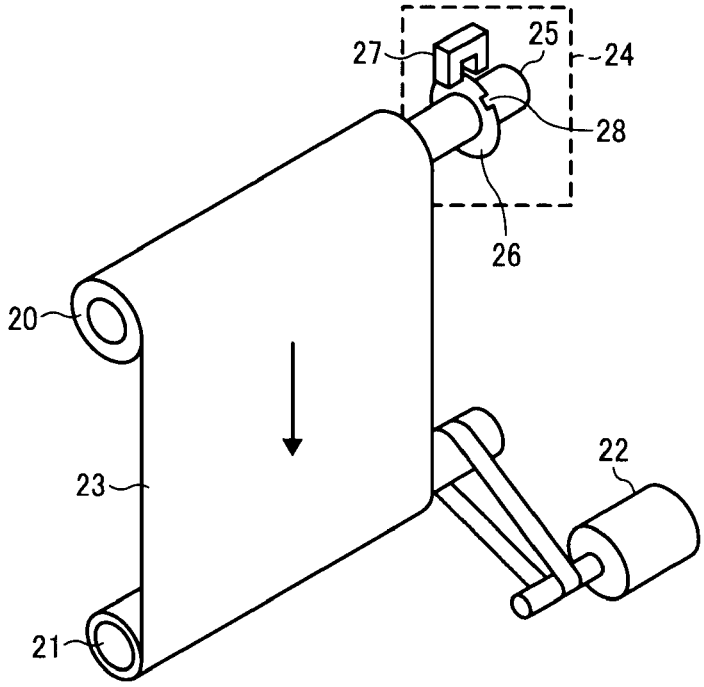
FIG. 1 PRIOR ART
FIG. 1 is a schematic diagram illustrating a background oil coating unit.
Figure 2:
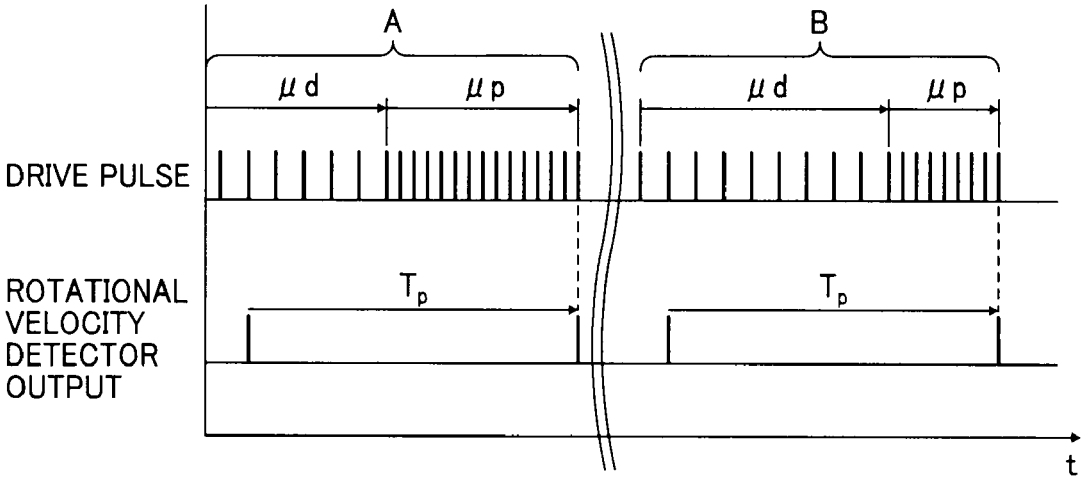
FIG. 2 PRIOR ART
FIG. 2 is a timing chart illustrating drive pulses and output signals of a rotation velocity detector of the background oil coating unit of FIG. 1.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Figure 3:
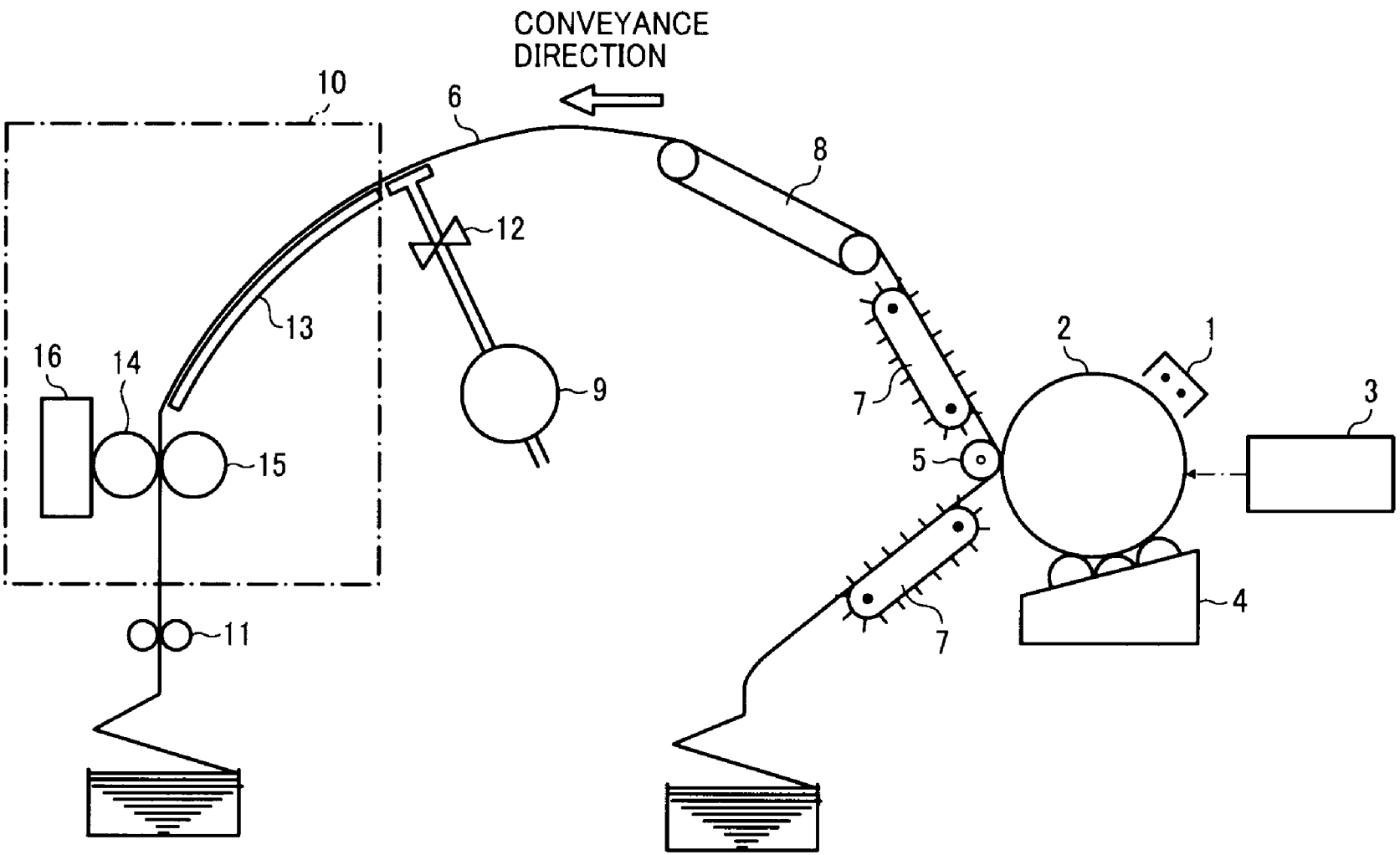
FIG. 3 is a schematic diagram illustrating a selected portion of an image forming apparatus according to an example embodiment of the present invention.

FIG. 3 is a schematic diagram illustrating a selected portion of an image forming apparatus. A laser beam emitted from a writing unit 3 is directed onto a surface of a photosensitive drum 2 that is charged uniformly by a charging device 1 to form an electrostatic latent image. The electrostatic latent image is developed by a developing unit 4 that supplies toner to form a toner image. The toner image is transferred onto print paper 6 by a transfer unit 5, and carried in the conveyance direction indicated by the arrow along a sheet conveyance path.

As shown in FIG. 3, a conveyance unit 7 such as a tractor, a buffer 8, an absorption unit 9, a fixing unit 10 functioning as a fixing device, and a pair of output rollers 11 are provided along the sheet conveyance path. The buffer 8 absorbs any slack in the print paper caused by a speed difference between the conveyance unit 7 and the fixing unit 10 so as to maintain proper tension on the print paper 6. The absorption unit 9 is provided so as to cause the print paper 6 having the toner image formed thereon to be in contact with a pre-heater 13 such that preheating is efficiently performed. The image forming apparatus 100 is provided with a switch pawl 12, which switches on or off of operation of air absorption applied to the print paper 6, for example, when the print paper 6 is firstly set at the fixing unit 10.

The fixing unit 10 includes the pre-heater 13, a heat roller 14 having a heater in its inside, a pressure roller 15, and an oil coating unit 16. The pressure roller 15 rotates in a backward direction so as to release the print paper 6 from the heat roller 14 when the print paper is stopped. Further, the pressure roller 15 presses the print paper 6 against the heat roller 14 to fix the toner image onto the print paper. The toner image formed on the print paper is fixed onto the print paper with heat supplied by the heat roller 14 and pressure applied by the pressure roller 15. The pair of output rollers 11 discharges the print paper 6 fixed with the toner image while applying tensile force to the print paper.

Figure 4:
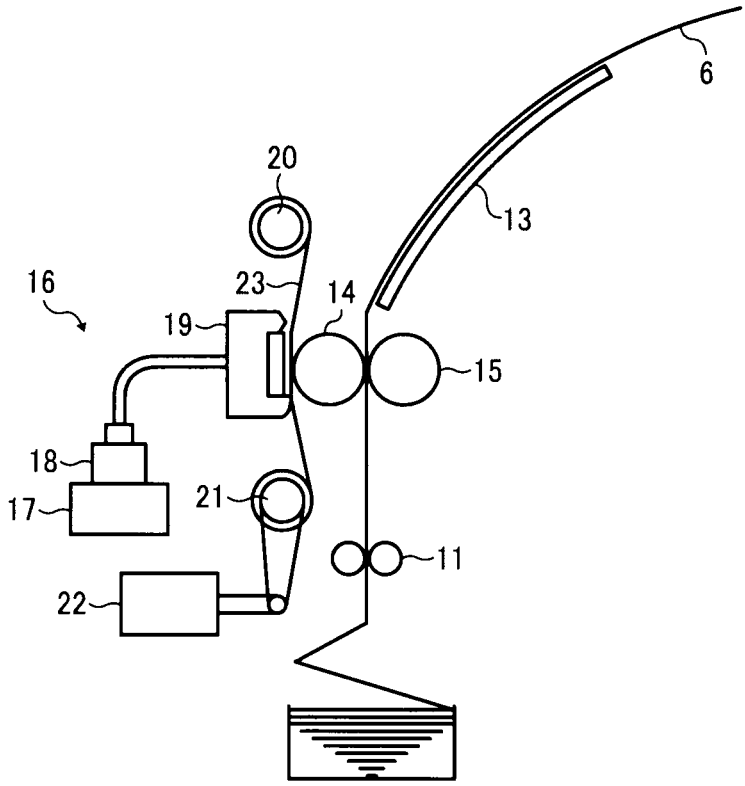
FIG. 4 is a schematic diagram illustrating an oil coating unit of the image forming apparatus of FIG. 3.

FIG. 4 is a schematic diagram illustrating a structure of the oil coating unit 16 of FIG. 3. The oil coating unit 16 includes an oil tank 17, an oil pump 18, an oil port 19, a felt subsidiary roller 20, a felt main roller 21, a drive motor 22, and a felt 23. The felt 23 is reeled from the felt subsidiary roller 20 to the felt main roller 21.

In printing operation, the oil pump 18 is driven so as to supply oil, such as silicon oil, from the oil tank 17 to the oil port 19 in small amounts. Since the oil port 19 is made in contact with the felt 23, the felt 23 is impregnated with the oil in the oil port 19 by capillary action.

Initially, the whole felt 23 is reeled by the felt subsidiary roller 20, and the felt 23 is suspended between the felt main roller 21 and the felt subsidiary roller 20. The felt 23 is fed as it is reeled by the felt main roller 21 for the following reasons. A portion of the toner of the toner image and paper particles from the print paper 6 may be accumulated on a surface of the felt 23 that is made in contact with the heat roller 14. Accordingly, it is necessary to clean the surface of the heat roller 14 that is in contact with the felt 23 by gradually feeding the felt 23. Further, oil may be coated on a surface of the heat roller 14 by the felt 23 so as to avoid fusion of the toner image onto the heat roller 14.

The felt subsidiary roller 20 is driven by the felt main roller 21. The drive motor 22 is driven to rotate with a constant angular velocity. However, as the felt 23 is reeled successively by the felt main roller 21, the outer diameter of the felt main roller 21 and the felt 23 gradually increases. As a result, the circumferential velocity of the felt 23 increases.

At around end of the reeling process to reel the felt 23, the felt 23 is reeled more quickly than a standard circumferential velocity under which the heat roller 14 can be sufficiently cleaned. Accordingly, a replacement cycle for the felt 23 may be shortened.

For example, when a diameter of the felt main roller 21 at the start time of the reeling process of the felt 23 is d1, the diameter of the felt main roller 21 at the end time of the reeling process of the felt 23 is d2, and the ratio d1:d2=1:2, a relation between a circumferential velocity v1 at the start time of the reeling process of the felt 23 and an circumferential velocity v2 at the end time of the reeling process of the felt 23 is expressed as v1:v2=1:2.

In order to solve the above-described problem, the image forming apparatus 100 is provided with a control unit that is able to keep the velocity of the felt 23 at a desired level even when the diameter of a roller changes as the felt 23 is reeled.

Figure 5:
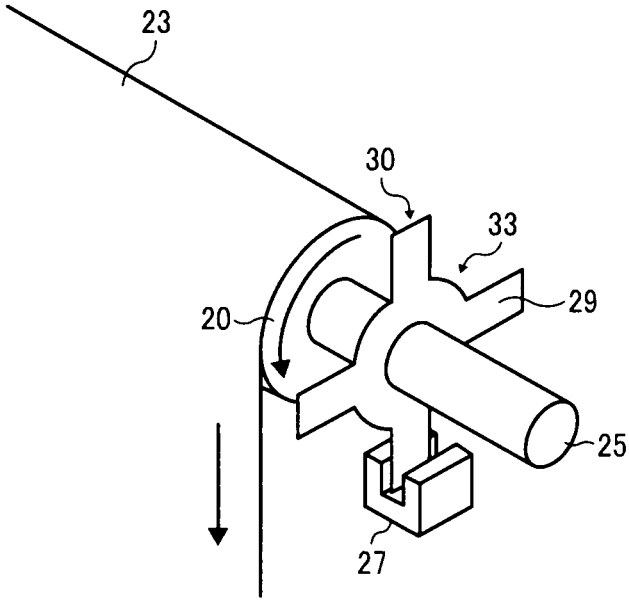
FIG. 5 is a perspective view of the oil coating unit of FIG. 4, which includes a felt subsidiary roller and an encoder disc.

FIG. 5 is a perspective view of an oil coating unit according to an embodiment of the present invention, which includes a felt subsidiary roller 20, and an encoder disc 29 integrally provided with the felt subsidiary roller 20.

As shown in FIG. 5, the encoder disc 29 is provided at one end of a rotational shaft 25 so as to be integrally formed with the rotational shaft 25 of the felt subsidiary roller 20. The encoder disc 29 has a circular or disc shaped surface, with a desired number of projections 30 formed around the outer circumference of the encoder disc 29 at regular intervals. For example, any number from two to around sixteen projections may be formed. The limits on the number of projections 30 are determined by the drive control method for controlling the drive motor 22 of the present embodiment, in which the number of drive steps of the drive motor 22 as detected by the encoder disc 29 is used to control the operation of the drive motor 22. Accordingly, an excessive number of projections 30 makes the detection interval too short to identify meaningful differences in the number of drive steps of the drive motor 22 corresponding to the change in diameter of a felt main roller 21, as explained with reference to FIG. 8.

Figure 8:
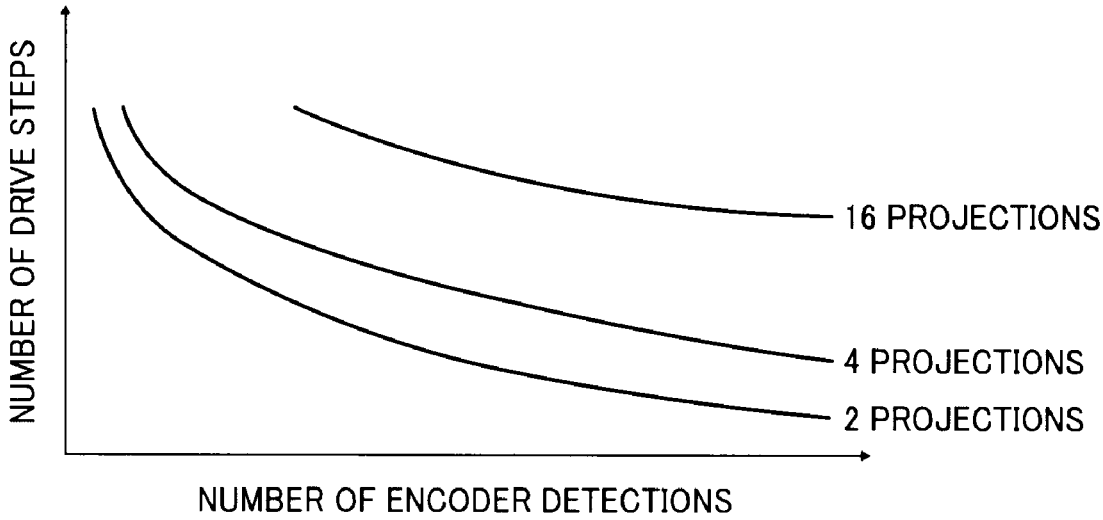
FIG. 8 is a graph representing a relation between the detection number of an encoding disc at one cycle and a number of drive steps during one cycle of the encoding disc.

FIG. 8 is a graph illustrating a relationship between the number of drive steps and the number of times the encoder carries out detection, in three different cases including the cases in which the encoder disc 29 has 2, 4, and 16 projections. As shown in FIG. 8, when the number of times the encoder disc 29 performs detection is increased, the difference in the number of steps is not very large to begin with and decreases thereafter, particularly in comparison with 2-projection and 4-projection configurations of the encoder disc 29. For this reason, the upper limit of the number of projections 30 is preferably around 16. In this embodiment, the encoder disc 29 has four projections 30. Further, a reed switch is employed as an encoder sensor 27 to detect the projections 30.

Together, the encoder disc 29 and the encoder sensor 27 constitute what in this specification is called an encoder.

Figure 6:
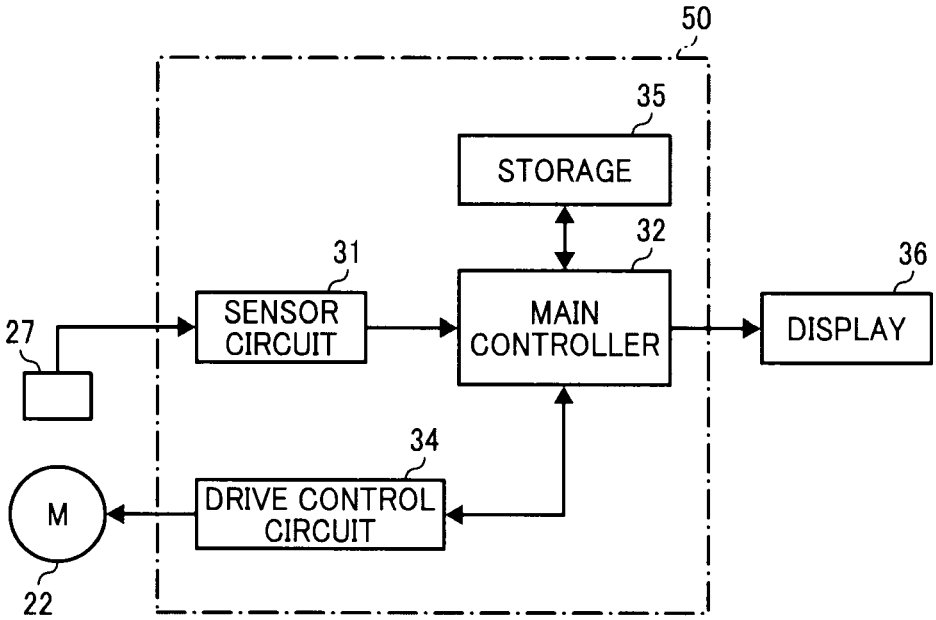
FIG. 6 is a block diagram of a motor control unit of the image forming apparatus of FIG. 3.

FIG. 6 is a block diagram of a motor control unit 50 used in the present embodiment. When the encoder sensor 27 detects one of the projections 30 of the encoder disc 29, a detection signal is transmitted to a main controller 32 through a sensor circuit 31. In this embodiment, when the encoder sensor 27 detects the projection 30 of the encoder disc 29, the encoder sensor 27 output is high. When the encoder sensor 27 detects a recessed portion 33 between the projections 30 of the encoder disc 29, the encoder sensor 27 output is low.

The drive motor 22 is controlled by the main controller 32 based on the control signal from the main controller 32 through the drive control circuit 34. The main controller 32 detects a state of the encoder, a high level or a low level, at each driving step of the drive motor 22.

In this embodiment, the encoder outputs a high level, then a low level, and outputs a high level again. A period of time between detection of one high level and the next high level defines one cycle of the encoder signal. Further, as shown in FIG. 6, a storage unit 35 is connected to the main controller 32 in this embodiment.

As previously described, the felt conveyance unit is a slow driving system. Further, since the felt 23 contacts the heat roller 14 that rotates, the encoder signal may change alternately between a high level and a low level rapidly for a short period of time as the encoder signal changes the polarity (switches between high and low output).

In this embodiment, to improve the detection accuracy of the encoder, the main controller 32 checks the encoder signal every time the drive motor 22 is driven by one step.

More specifically, when the main controller 32 recognizes firmly the polarity change of the encoder signal, a high level to a low level, or a high level to a low level, the polarity of the signal is determined. In other words, when the same signal state (either high or low) continues for a given number of steps of the driving motor 22 (for example, several hundred steps) after detecting a signal edge of the projection 30 of the encoder disc 29 or a signal edge of the recessed portion 33 of the encoder disc 29, the polarity is determined.

It is to be noted that the felt main roller 21 increases a diameter thereof while the felt main roller 21 reels the felt 23 in. By contrast, the felt subsidiary roller 20 decreases a diameter thereof while the felt subsidiary roller 20 feeds the felt 23 out. Accordingly, when the drive motor 22 is driven by one step, a rotational angle of the felt subsidiary roller 20 differs according to the used amount of the felt 23. Therefore, it is necessary to decide the number of steps the drive motor 22 is to be driven in consideration of a reeled condition of the felt 23.

One example procedure used in the present embodiment for obtaining the number of steps the drive motor 22 is to be driven will now be described.

Figure 9:
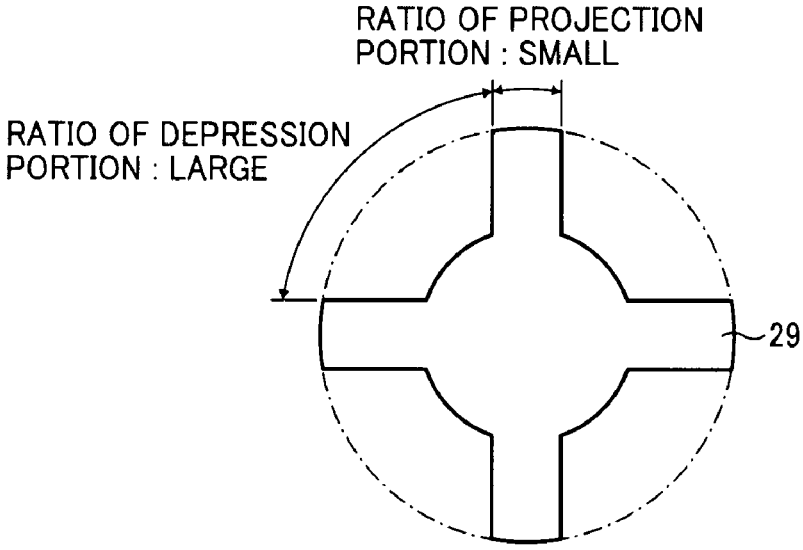
FIG. 9 is a schematic diagram of an encoder disc having projections and depressions to explain how to obtain a given step number.

First, either one of the projections 30 or one of the recessed portions 33 of the encoder disc 29 is selected as a detection target by considering the size of its angular ratio. As between the projection 30 and the recessed portion 33, that portion which has a smaller angular ratio is selected. In this embodiment, as shown in FIG. 9, the projection portion has a smaller angular ratio than the depression portion. Further, preferably the number of steps by which the drive motor 22 is to be driven is such that the polarity of the signal is determined at the center of the projection portion.

Figure 10:
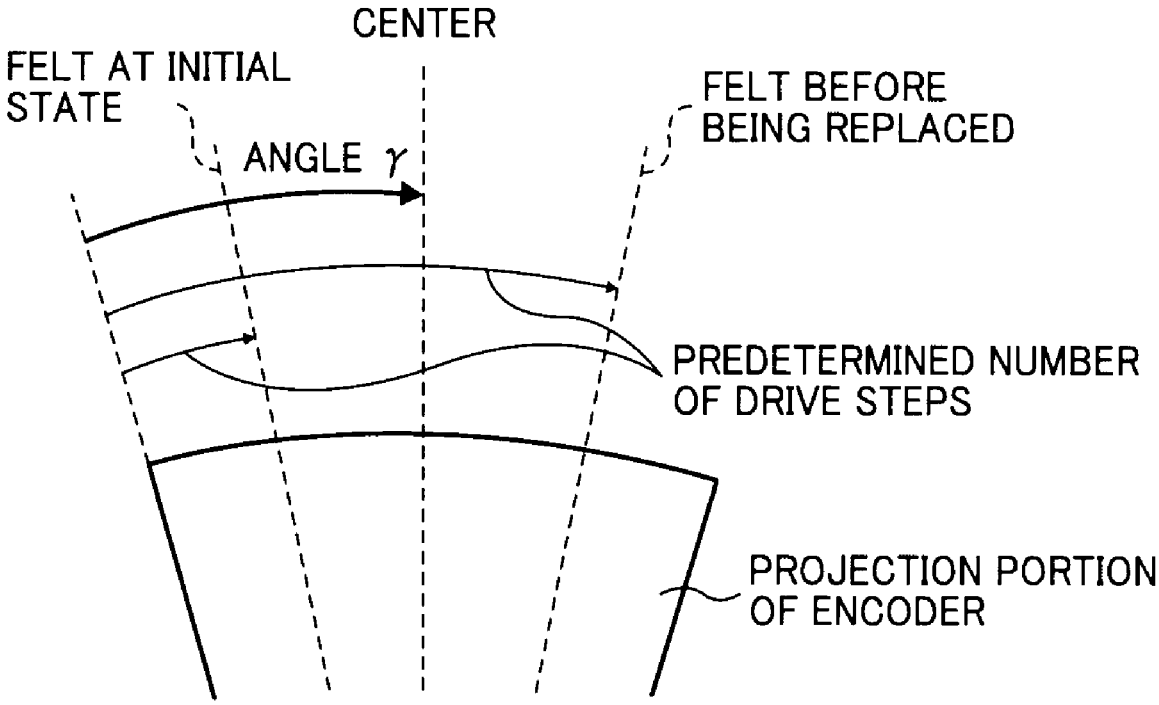
FIG. 10 is a schematic representing an angle after being driven by a given step number corresponding to reeled length of the felt.

As shown in FIG. 10, when the half angle for the projection 30 is $\gamma$, then the number of drive steps of the drive motor 22 necessary for the felt subsidiary roller 20 to drive through such half angle $\gamma$ is 1000 steps at an initial state of the felt 23.

Further, at a final state of the felt 23 after the felt 23 has been used, and just before the felt 23 should be exchanged, the number of drive steps of the drive motor 22 necessary to drive through such the angle $\gamma$ by the felt subsidiary roller 20 is 500 steps. In this case, the given step number may be defined to be 750 steps, which is an intermediate number between the step numbers at the initial state and the final state [=(1000+500)/2].

A polarity of the signal level, a high level or a low level, is identified once the same signal level continues for a given number of drive steps.

Consequently, it is possible to avoid error detection caused by chattering of the encoder signal due to, for example, vibration of the fixing device. As a result, it is possible to identify the encoder signal reliably.

Figure 7:
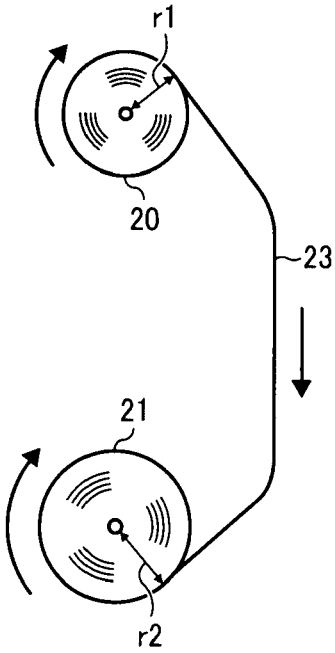
FIG. 7 is a schematic diagram illustrating a configuration of a felt conveyance unit.

Referring to FIG. 7, a felt conveyance mechanism is described. In this embodiment, as noted above, the encoder disc 29 includes four projections 30. Accordingly, the rotational angle is 90 degrees between detection intervals of the encoder disc 29 of the felt subsidiary roller 20. As shown in FIG. 7, when a radius of the felt subsidiary roller 20 including thickness of the felt 23 is defined as $r_1$, the conveyance length w1 of the felt 23 that is conveyed between a detection interval between successive detections of the encoder (90 degrees) is expressed as:

$$W1=2\pi r_1\times 1/4=(\pi/2)\times r_1 \quad (1).$$

When a radius of the felt main roller 21 including thickness of the felt 23 is defined as $r_2$, the drive pulse number necessary for one turn of the felt main roller 21 is c, and the drive pulse number at the detection of the felt encoder is b, the conveyance length w2 of the felt 23 that is conveyed between a detection interval between successive detections of the encoder is expressed as:

$$W2=(b/c)\times 2\pi r_2 \quad (2)$$

Since the felt main roller 21 and the felt subsidiary roller 20 convey the same felt 23, the conveyance length W1 by the felt subsidiary roller 20 between successive detections of the encoder is equal to the conveyance length W2 by the felt main roller 21. (W1=W2) Accordingly, it is expressed by the formula (3):

$$(\pi/2)\times r_1=(b/c)\times 2\pi r_2 \quad (3).$$

As described above, the felt main roller 21 increases a diameter thereof while the felt main roller 21 reels the felt 23 in. By contrast, the felt subsidiary roller 20 decreases a diameter thereof by the same amount.

Accordingly, the sum of the radius r1 of the felt subsidiary roller 20 and the radius $r_2$ of the felt subsidiary roller 20 is approximated by the formula (4) using a fixed value $$L: r_1+r_2\approx L \quad (4)$$

Accordingly, the radius $r_2$ of the felt main roller 21 can be defined by the formula (5):

$$r_2=(L\times c)/(4b+c) \quad (5)$$

When the main controller 32 detects one cycle of the encoder signal, the main controller 32 calculates the radius $r_2$ of the felt subsidiary roller 20 based on the formula (5). The rotational velocity of the drive motor 22 is controlled according to the radius $r_2$ so that the circumferential velocity of the felt 23 can be kept constant.

For example, where the radius of the felt main roller 21 is r0 at the beginning of the usage of the felt, it is possible to convey the felt at a constant velocity by changing the drive velocity of the drive motor 22 by the changing ratio of the $r_2$ corresponding to the radius r0.

Again, when the felt 23 has been reeled normally, the felt main roller 21 increases a diameter thereof while the felt main roller 21 reels the felt 23 in. By contrast, the felt subsidiary roller 20 decreases a diameter thereof. At this time, the number of drive steps of the drive motor 22 during one cycle of the felt encoder signal is decreasing. Further, when the felt 23 has been reeled normally, it is possible to easily calculate a changing rate of the number of drive steps of the drive motor 22 during one cycle of the felt encoder signal, which decreases and converges to a certain value.

As shown in FIG. 6, a storage unit 35 may be employed and connected to the main controller 32 to store a number of drive steps of the drive motor 22. At every detection of one cycle of the felt encoder signal, the storage unit 35 stores the number of drive steps of the drive motor 22 during one cycle. The information of the number of drive steps of the drive motor 22 can be obtained from the drive control circuit 34. Every time one cycle of the encoder signal is detected, the main controller 32 compares the new number of drive steps of the drive motor 22 with the previous number of drive steps of the drive motor 22. When the new number of drive steps becomes larger than the previous number of drive steps, or the new number of drive steps becomes smaller than the previous number of drive steps, the main controller 32 determines that some malfunction has occurred and displays an error message on a display 36 such as an operation panel provided with a printing apparatus or a control device of the apparatus to inform an operator that an occurrence of the malfunction to the operator.

The malfunction may be detected when the drive motor 22 has mechanical trouble or the sensor system that checks the encoder disc 29 performs an erroneous function. Further, the malfunction may be detected when the felt is replaced with a different but used felt just before the felt is rolled out. In such case, the outer diameter of the felt main roller 21 and the felt portion after replacement may be smaller than the outer diameter of the felt main roller 21 and the felt portion that is calculated by the main controller 32. Under these conditions, when the drive motor 22 is driven with the calculated velocity, the felt may be fed with a velocity slower than the velocity necessary to sufficiently clean the heat roller 14.

When a malfunction is detected, the main controller 32 outputs a velocity switch signal to the drive control circuit 34 to drive the drive motor 22 at an initial velocity that can sufficiently clean the fixing device. The initial velocity is a drive velocity of the cleaning mechanism of the fixing device with which the fixing device can be sufficiently cleaned, and is determined at the design stage.

Additionally or alternatively, the main controller 32 may calculate a used felt amount or a remaining felt amount, as described below.

FIG. 8, as described above, is a graph illustrating a relationship between the number of detections of the encoder disc 29 and the number of drive steps of the drive motor 22 during one cycle of the encoder disc 29. The horizontal axis of FIG. 8 is the number of detections of the encoder disc 29, and the vertical axis of FIG. 8 is the number of drive steps of the drive motor 22 during one cycle of the encoder disc 29.

Since the outer diameter of the felt main roller 21 and the felt portion increases every time the drive motor 22 is driven, the number of drive steps of the drive motor 22 during one cycle of the encoder disc 29 decreases. This relation is established by the information of the number of drive steps of the drive motor 22 during one cycle of the encoder disc 29 independently of the drive velocity of the drive motor 22. Accordingly, it is possible to calculate and identify the used amount or the remaining amount of the felt 23 by checking the number of drive steps of the drive motor 22 during one cycle of the encoder disc 29 every time one cycle of the encoder disc 29 is detected.

The used amount or the remaining amount of the felt 23 is displayed on the display 36 to inform the operator of the usage status of the felt 23 in real time, so that the operator can exchange the felt 23 at the proper time.

In the above embodiment, the encoder disc 29 is provided with the projections 30 and the recessed portions 33. Alternatively, reflecting portions and non-reflecting portions may be used instead of the projections 30 and the recessed portions 33 to detect the rotational status.

Further, in the above embodiment, although felt is employed as the oil impregnation member, alternatively unwoven fabric or woven fabric may be employed instead of felt.

A variety of modifications and variations of the present invention are possible in light of the above teachings. For example, it is possible to apply these teachings to a cleaning device for a transfer belt and a toner supply device that conveys new toner. Alternatively, the above-described teachings may be applied to any desired device that reels a member of rectangular shape, or any desired device that detects the usage amount or remaining amount of the rectangular shaped member.

Numerous additional modifications and variations are possible in light of the above teachings. It is therefore to be understood that, within the scope of the appended claims, the disclosure of this patent specification may be practiced otherwise than as specifically described herein.

With some embodiments of the present invention having thus been described, it will be obvious that the same may be varied in many ways. Such variations are not to be regarded as a departure from the spirit and scope of the present invention, and all such modifications are intended to be included within the scope of the present invention.

For example, elements and/or features of different illustrative embodiments may be combined with each other and/or substituted for each other within the scope of this disclosure and appended claims.

For example, in alternative to obtaining an outer diameter of the main roller and the felt portion, an outer diameter of the subsidiary roller and a portion of the felt that remains on the subsidiary roller may be calculated and used to determine a velocity of driving the felt.

Further, as described above, any one of the above-described and other methods of the present invention may be embodied in the form of a computer program stored in any kind of storage medium. Examples of storage mediums include, but are not limited to, flexible disk, hard disk, optical discs, magneto-optical discs, magnetic tapes, involatile memory cards, ROM (read-only-memory), etc.

Alternatively, any one of the above-described and other methods of the present invention may be implemented by ASIC, prepared by interconnecting an appropriate network of conventional component circuits or by a combination thereof with one or more conventional general purpose microprocessors and/or signal processors programmed accordingly.

In one example, the present invention may reside in: an oil coating device including: an oil impregnation member, having a rectangular shape, to coat oil onto a surface of a member to be coated; means for supplying oil to the oil impregnation member; a subsidiary roller to feed the oil impregnation member; a main roller to reel the oil impregnation member fed by the subsidiary roller; a drive motor to drive the main roller; an encoder disc provided at a rotational shaft of the subsidiary roller; an encoder sensor to detect a rotational state of the encoder disc; and roller outer diameter calculation means for calculating an outer diameter of the main roller and a portion of the lubricant impregnation member reeled by the main roller, based on a number of drive steps of the drive motor during a detection interval of the encoder disc.

In one example, the oil coating device further includes: drive velocity determination means for determining a drive velocity of the drive motor based on the outer diameter of the main roller and the portion of the lubricant impregnation member calculated by the roller outer diameter calculation means.

Since the outer diameter of the main roller and the portion of the lubricant impregnation member is calculated based on the number of drive steps of the drive motor detected during the detection interval of the encoder disc, and such calculated outer diameter is used to determine a velocity of the drive motor, the conveyance velocity of the oil impregnation member is kept at a desired level. This suppresses the impregnation member to be wasted as the impregnation member is reeled at a speed higher than it is expected, while allowing the impregnation member to sufficiently clean the heating member. Thus, the reproducibility of the image forming apparatus increases, while extending a usage time of the impregnation member.

In one example, the oil coating device further includes: a storage to store the number of drive steps of the drive motor detected during the detection interval of the encoder disc; and abnormality determination means for determining an abnormal operation by comparing the latest detected number of drive steps of the drive motor with the previous number of drive steps of the drive motor.

In one example, the oil coating device further includes: oil impregnation amount calculation means for calculating an used amount or a remaining amount of the oil impregnation member based on the number of drive steps of the drive motor obtained during the detection interval of the encoder disc. For example, information regarding the used amount or the remaining amount may be notified to an operator of the image forming apparatus. Based on this notification, the operator may determine whether to replace the oil impregnation member.

In one example, the oil coating device further includes: abnormality determination means for determining an abnormal operation when the encoder sensor does not output a signal. For example, information regarding this determination may be notified to the operator. In this manner, the operator is able to detect when there is an error in the drive motor, or an error in the encoder sensor, more easily.

In one example, in the oil coating device, when the abnormality determination means determines that the abnormal operation occurs, the velocity of the drive motor is changed to a predetermined velocity under which the member to be coated with oil by the oil impregnation member can be sufficiently cleaned. In this manner, even when the oil impregnation member is replaced with a different but used oil impregnation member, In one example, in the oil coating device, the polarity change of the encoder signal is recognized when the same signal state continues for a given step number after detecting a edge of the projections or depressions formed at regular intervals at outer circumference of the encoder disc. In this manner, the polarity of the encoder signal can be detected with improved accuracy.

What is claimed is:

1. A lubricating device comprising:

a lubricant impregnation member configured to coat a surface of a target member with lubricant;

a lubricant supply member configured to supply lubricant to the lubricant impregnation member;

a subsidiary roller configured to feed the lubricant impregnation member out;

a main roller configured to reel in the lubricant impregnation member fed out by the subsidiary roller;

a drive motor configured to drive the main roller;

an encoder disc provided at a rotational shaft of the subsidiary roller;

an encoder sensor adjacent to the encoder disc and configured to detect a rotational state of the encoder disc;

a controller unit configured to receive output from the encoder sensor and to calculate an outer diameter of the main roller and a portion of the lubricant impregnation member reeled by the main roller, based on a number of drive steps of the drive motor detected by the encoder sensor during a detection interval of the encoder disc, and to determine a drive velocity of the drive motor based on the calculated outer diameter.

2. The lubricating device of claim 1, further comprising a storage unit configured to store the number of drive steps of the drive motor detected by the encoder sensor during the detection interval of the encoder disc, wherein the controller unit further identifies a malfunction by comparing a latest detected number of drive steps of the drive motor with a previous number of drive steps of the drive motor stored in the storage unit.

3. The lubricating device of claim 1, wherein the controller unit further calculates a used amount or a remaining amount of the lubricant impregnation member based on the number of drive steps of the drive motor detected by the encoder sensor during the detection interval of the encoder disc.

4. The lubricating device of claim 1, wherein the controller unit further identifies a malfunction when the encoder sensor does not output a signal.

5. The lubricating device of claim 2, wherein, when the controller unit identifies a malfunction, the controller unit changes a drive velocity of the drive motor to a predetermined velocity sufficient to clean the target member to be coated with lubricant with the lubricant impregnation member.

6. The lubricating device of claim 1, wherein the encoder disc is provided with alternating projections and depressions formed at regular intervals along an outer circumference of the encoder disc.

7. The lubricating device of claim 6, wherein a change in polarity of the encoder signal is identified when the same signal state continues for a given number of steps of the drive motor after detection of an edge of the alternating projections or depressions formed at regular intervals along the outer circumference of the encoder disc.

8. A fixing device comprising:

a heat roller;

a pressure roller configured to press a sheet of recording media bearing a toner image against the heat roller; and the lubricating device of claim 1 configured to coat a surface of the heat roller with lubricant.

9. An image forming apparatus comprising:

a photoreceptor;

a charging unit configured to charge a surface of the photoreceptor;

a writing unit configured to form an electrostatic latent image on the charged surface of the photoreceptor by exposing a laser light;

a developing unit configured to form a toner image by supplying toner on the electrostatic latent image;

a conveyance unit configured to convey a recording medium;

a transfer unit configured to transfer the toner image onto the recording medium; and the fixing unit of claim 8, configured to fix the transferred toner image on the recording media.

* * * * *